US005517824A

United States Patent [19]

Konishi et al.

[11] Patent Number: 5,517,824

[45] Date of Patent: May 21, 1996

[54] REFRIGERATING CYCLE

[75] Inventors: Hiroshige Konishi; Susumu Kawaguchi; Hitoshi Maruyama, all of Shizuoka; Yoshihiro Sumida, Hyogo, all of Japan

[73] Assignee: Mitsubishi Denki Kabushiki Kaisha, Tokyo, Japan

[21] Appl. No.: 267,906

[22] Filed: Jul. 6, 1994

[30] Foreign Application Priority Data

Sep. 30, 1993 [JP] Japan ..... 5-245040
Dec. 28, 1993 [JP] Japan ..... 5-335998

[51] Int. Cl.[6] ..... G10F 1/12

[52] U.S. Cl. ..... 62/84; 62/114; 62/468

[58] Field of Search ..... 62/84, 468, 498, 62/114

[56] References Cited

U.S. PATENT DOCUMENTS 525,224 8/1894 Miles et al. ..... 62/84
3,512,374 5/1970 Grahl .
5,372,737 12/1994 Spauschus ..... 62/84

FOREIGN PATENT DOCUMENTS 0184200 6/1986 European Pat. Off. .
2-276894 11/1990 Japan .
3-3981 1/1991 Japan .
3-128991 5/1991 Japan .
1084279 9/1967 United Kingdom .
1121263 7/1968 United Kingdom ..... 62/84
1521251 8/1978 United Kingdom .

OTHER PUBLICATIONS

Fluid Mechanics, Vennard p 74, 1955.
Die Kalte–und Klimatechnik (Refrigerating and Climate Engineering), Mar. 1982, pp. 80, 82 and 83, Theo Mang, "Schmierole fur Kuhlmaschinen und Warmepumpen".
Ki Klima–Kalte–Heizung (Ki Climate–Cold–Heating), Oct. 1985, pp. 387–389, E. Gottfried, "Olruckfuhrung in Kalteanlagen".

*Primary Examiner*—William E. Wayner
*Attorney, Agent, or Firm*—Oblon, Spivak, McClelland, Maier & Neustadt

[57] ABSTRACT

In a refrigerating cycle using a refrigerant containing hydrofluorocarbon as a main component, of a refrigerant pipe arrangement constituting the refrigerating cycle, a refrigerant pipe extending upward from a lower side to an upper side is made to have an inner diameter not larger than a value which makes the flow rate of the refrigerant be not smaller than a zero penetration flow rate. It is possible to obtain a refrigerating cycle superior in oil returning to a compressor and hence high in reliability, even in the case of using refrigerator oil having no compatibility with a refrigerant containing hydrofluorocarbon as a main component.

12 Claims, 4 Drawing Sheets

REFRIGERATING CYCLE

BACKGROUND OF THE INVENTION

The present invention relates to a refrigerating cycle using a refrigerant containing hydrofluorocarbon as a main component.

FIG. 3 shows an example of a conventional refrigeration unit.

Conventionally, for example, as shown in "Tripologist", vol. 35, No. 9 (1990), pp. 621 to 626, in the case of designing a refrigeration unit with HFC134a refrigerant which is hydrofluorocarbon, compatibility of the refrigerant and refrigerator oil is one of important characteristics, and PAG (polyether) or ester refrigerator oil has been used. FIG. 5 shows a refrigeration unit using HFC134a refrigerant. In FIG. 5, the reference numeral 1 represents a compressor for compressing refrigerant gas; 2, a condenser for condensing high-pressure refrigerant gas ejected from the compressor 1; 3, a capillary tube; 4, an evaporator; 5, a header having a refrigerant quantity adjustment function; and 6, refrigerator oil reserved in the compressor 1 for lubricating a sliding portion of the compressor 1 and sealing a compression room. PAG 6*a* or ester refrigerator oil 6*b* is used as the refrigerator oil 6.

Next the operation will be described. The refrigerant compressed by the compressor 1 is ejected into the condenser 2. Here, most of the lubricating oil 6*a* or 6*b* used for sealing the compression room and so on is separated in the compressor which uses, for example, a high pressure vessel. That is to say, about 0.5 to 1.0 weight percentage of the oil 6*a* or 6*b* relative to the refrigerant is ejected from the compressor 1 together with the refrigerant. Having compatibility or solubility with the refrigerant, the ejected oil 6*a* or 6*b* has enough fluidity to return to the compressor 1 through the condenser 2, the capillary tube 3, the evaporator 4 and the header 5. Accordingly there is no case where the lubricating oil 6 disappears from the compressor 1. Therefore, normal lubrication can be realized. In addition, there has been a possibility that the refrigerant foams in so-called sleeping of the refrigerant when the compressor 1 is stopped for a long time.

A conventional refrigeration unit using HFC134a as a refrigerant has such a configuration as described above. The polyether 6*a* used as refrigerator oil has volume resistivity in a range of from $10^7$ to $10^{10}$ Ω·cm and saturated water content of about 25,000 ppM, and the ester refrigerator oil has improved characteristics such as volume resistivity in a range of from $10^{12}$ to $10^{14}$ Ω·cm and saturated water content of about 1,500 ppM. However, they show much deteriorated characteristics in electric insulation and moisture absorbing property in comparison with present CFC12 refrigerator oil having characteristics such as volume resistivity of $10^{15}$ Ω·cm and saturated water content of about 500 ppM. The insulation has a problem relating to long-term reliability of a compressor. As for the moisture absorbing property, also on dealing with assembly parts of the compressor or dealing with the completed compressor, it is necessary to make the saturated water content as small as possible, so that there has been a problem that the dealing is troublesome.

There have also been many problems of dealing on manufacture at the time of assembling a refrigerator, such as reducing the opened time of a refrigerating cycle. In addition, there have been a problem that if a large quantity of water content gets into the refrigerating cycle, the production of sludge is accelerated, or the water content is frozen to close capillary tubes to cause a cooling fault, or the like.

In addition, in a conventional refrigeration unit using HFC134a as a refrigerant, if the refrigerant has high moisture absorbing property, such various problems occur that it becomes difficult to prevent parts of a compressor from getting rusty; that a capillary tube or an expansion valve of a refrigerating air-conditioning apparatus is closed by icing; that moisture accelerates hydrolysis of ester oil so as to produce sludge; that moisture accelerates hydrolysis of polyethylene terephthalate used as insulating material of a motor so as to produce sludge; and so on. In order to prevent these defects, on the process of manufacture, it has been necessary to eliminate moisture in oil and moisture in a refrigerant circuit more carefully than that in a system using CFC12 refrigerant. In addition, in order to increase the moisture capturing ability of a dryer provided in the refrigerant circuit, there has been a problem that it is necessary to provide a larger dryer than a conventional one.

In addition, in a conventional refrigeration system, a liquid refrigerant returns into a compressor vessel through a suction inlet at the time of stopping a compressor, and lubricating oil in the compressor is brought into the refrigeration system from the compressor together with the liquid refrigerant at the time of restarting the compressor. Since the brought lubricating oil is HFC134a refrigerant which is low in compatibility, the brought lubricating oil is difficult to return to the compressor until the quantity of flow (=flow rate) becomes a value not smaller than a predetermined value. Accordingly there has been a problem that compressor troubles occur due to lack of the lubricating oil.

SUMMARY OF THE INVENTION

The present invention has been attained to solve the foregoing problems. It is an object of the present invention to obtain a refrigerating cycle superior in electric insulation and moisture absorbing property and so high in reliability that refrigerator oil surely returns to a compressor without being reserved in a refrigeration system.

According to the present invention, in the refrigerating cycle using a refrigerant containing hydrofluorocarbon as a main component, of a refrigerant pipe arrangement constituting the refrigerating cycle, a refrigerant pipe extending upward from a lower side to an upper side is made to have an inner diameter not larger than a value which makes oil adhering to the inner wall of the refrigerant pipe rise when the refrigerant rises in the one pipe or which makes the flow rate of the refrigerant be not smaller than a zero penetration flow rate.

According to the present invention, in the refrigerating cycle using a refrigerant containing hydrofluorocarbon as a main component, a constituent element of the refrigerating cycle where the flow rate of the refrigerant is not larger than a zero penetration flow rate is designed so as to make the direction of flow of the refrigerant in the constituent element be horizontal or downward.

According to the present invention, in the refrigerating cycle, a header provided in an outlet of an evaporator is designed so as to make the direction of flow of the refrigerant downward, and a suction pipe on the lower side of the outlet of the header is inserted into the header.

According to the present invention, in the refrigerating cycle, the internal volume of the header up to the upper surface of the suction pipe inserted to the header is set so as to cause no trouble against running of a compressor even if the quantity of refrigerator oil reserved in the header increases.

According to the present invention, in the refrigerating cycle, liquid reserved in a trap portion of the refrigerant pipe is made to be minimum.

According to the present invention, in the refrigerating cycle, a muffler provided on the suction side of a compressor makes the direction of flow of the refrigerant downward, a pipe on the outlet lower side is inserted into the muffler, and a small hole is provided in a lower portion of the pipe at the inserted portion thereof.

According to the present invention, it is possible to obtain a refrigerating cycle superior in oil returning to a compressor and hence high in reliability, even by use of refrigerator oil having no compatibility with a refrigerant containing hydrofluorocarbon as a main component.

According to the present invention, it is possible to obtain a refrigerating cycle superior in oil returning to a compressor without reserving oil in a pipe arrangement, even by use of refrigerator oil having no compatibility with a refrigerant containing hydrofluorocarbon as a main component.

In the refrigerating cycle according to the present invention, refrigerator oil lighter in specific gravity than a refrigerant containing hydrofluorocarbon as a main component is reserved in an upper portion of the header. Accordingly the refrigerator oil returns to the compressor without being reserved in the header as soon as running is started.

The refrigerator cycle according to the present invention gives no troubles to the running of the compressor even if the refrigerator oil is reserved up to the upper end surface of a suction pipe inserted into the header.

In the refrigerator cycle according to the present invention, the refrigerator oil is prevented from being reserved in a trap portion.

In the refrigerator cycle according to the present invention, even if a muffler is filled with the refrigerant and the refrigerator oil, the refrigerant larger in specific gravity is reserved in the lower portion while the refrigerator oil is reserved in the upper portion. Then, the refrigerant returns to the compressor through a small hole sooner at the time of restarting. Accordingly it is possible to reduce the load caused by sucking oil into the compressor.

DETAILED DESCRIPTION OF THE PREFERRED EMBODIMENTS

Embodiment 1

Figure 1:
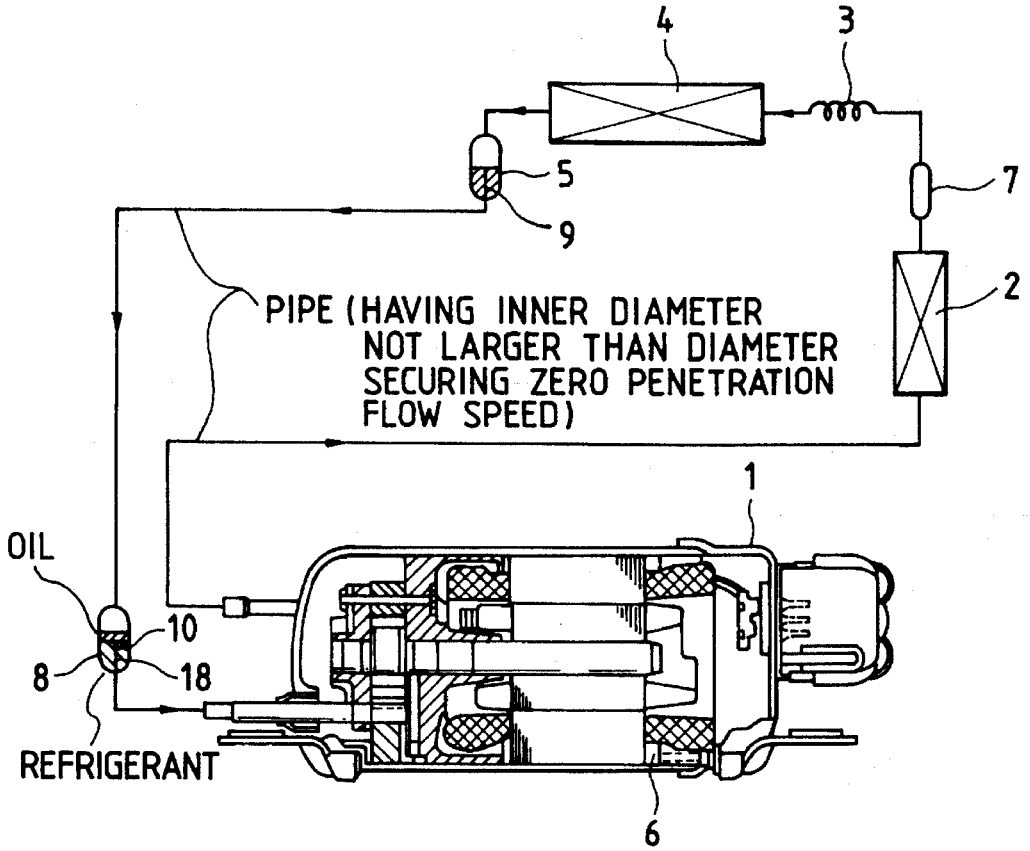
FIG. 1 is a constituent diagram of a refrigeration unit using a refrigerant compressor according to Embodiments 1 to 6 of the present invention.

Embodiment 1 of the present invention will be described with reference to FIG. 1. In the drawing, the reference numeral 1 represents a compressor for compressing refrigerant gas; 2, a condenser for condensing high-pressure refrigerant gas ejected from the compressor 1; 3, a capillary tube which is a pressure reducing means; and 4, an evaporator for evaporating low-pressure liquefied refrigerant. The reference numeral 6 represents refrigerator oil reserved in the compressor 1 for lubricating a sliding portion of the compressor 1 and for sealing a compression room. As the refrigerator oil 6, hard alkylbenzene oil or poly-alpha-olefin oil can be used, which has no compatibility with a refrigerant HFC134a so that the oil and the refrigerant are in the form of two-phase separation in a liquid portion in the refrigerating cycle. Further, of a refrigerant pipe arrangement in the refrigerating cycle of the present invention, an ascending pipe where the flow of the refrigerant goes upwards from the lower side is designed so as to have an inner diameter which is not larger than a value in which the flow rate of the refrigerant becomes not less than a certain flow rate (zero penetration flow rate) so that refrigerator oil adhering to the inner wall of the ascending pipe rises against its own gravity.

This zero penetration flow rate is calculated from the inner diameter of the pipe and the state values of air/liquid refrigerant. The zero penetration flow rate Ug* is calculated by use of a Wallis' experimental equation shown in Equation 1.

$$Ug^* = \left\{ g \cdot dx \cdot \left( \frac{\rho oil - \rho g}{\rho g} \right) \right\}^{0.5} \quad \text{[Equation 1]}$$

$$= \{g \cdot dx \cdot (867\, Vx - 1)\}^{0.5}$$

wherein:

g: gravitational acceleration (m/sec$^2$)

ρoil: oil liquid density (Kg/m$^3$)=867(Kg/m$^3$)

ρg: refrigerant gas density (Kg/m$^3$)

dx: pipe inner diameter in the state x (m)

Vx: specific volume in the state x (m$^3$/Kg)

The state x in Equation 1 means a state of running.

The flow rate Ug of the refrigerant flowing in the pipe is calculated by Equation 2.

Oil adheres to the inner wall of the pipe by a frictional force, and a force for the oil to drop down by its own gravity acts to the oil. If a rising force for the refrigerant to flow upward is larger than a combined force of a force to shear this adhering force and the dropping force, the oil receives a force from the refrigerant so as to rise. For this, the condition where the pipe is vertical is the most difficult, and, for example, the condition of an oblique up/down relationship is easier.

$$G = SV \cdot N \cdot \eta v / Vs$$

$$Ug = G \cdot Vx / \{\pi (dx/2)^2\}$$

$$Ug = SV \cdot N \cdot \eta v \cdot Vx / \{Vs \cdot \pi (dx/2)^2\} \quad \text{Equation 2}$$

wherein:

G: mass flow (Kg/s)

SV: stroke volume of a compressor (m$^3$)

N: rotation number (rps)

ηv: volume efficiency

Vs: specific volume of sucked gas (m$^3$/Kg)

If the refrigerant flow rate Ug calculated thus is larger than the zero penetration Ug*, refrigerator oil adhering to the inner wall of the pipe rises against its own gravity even in an ascending pipe, so that the oil is not reserved in the pipe. It is therefore necessary to make the pipe inner diameter dx not larger than a certain diameter so that Ug>Ug*. For example, the pipe inner diameter is not larger than 4.5 mm in a compressor having stroke volume 5 (cc). The pipe inner diameter is not larger than 10 mm in a compressor having stroke volume 10 (cc). This is the case of a vertically ascending pipe, which is the most difficult condition. In the case of an obliquely ascending pipe, the condition for oil return gets improved. Further, transient start-up time or the like before stabilizing the running of a compressor is so short that there is no problem. The stroke volume of a compressor is, for example, equivalent to the volume of a cylinder 16 in a rotary compressor. This applies to a reciprocating or scrolling compressor.

The pipe arrangement inner diameter dx where Ug=Ug* is expressed by Equation 3 from Equations 1 and 2.

[Equation 3]

$$dx = \left\{ \frac{16}{g \cdot (867\,Vx - 1)} \cdot \left( \frac{SV \cdot N \cdot \eta v \cdot Vx}{\pi \cdot Vs} \right)^2 \right\}^{1/5}$$

Now, let the temperature conditions be set to condensation temperature 40° C., evaporation temperature −30° C. and suction temperature 30° C., and Vs=0.28652 and Vx=0.02003 are established. Accordingly dx becomes a function of SV as shown in Equation 4.

$$dx = 0.602 \cdot SV^{0.4} \qquad \text{Equation 4}$$

Let the evaporation temperature be −40° C., and Vs=0.28652 is established. Accordingly dx can be expressed by Equation 5.

$$dx = 0.493 \cdot SV^{0.4} \qquad \text{[Equation 5]}$$

[0032]

Vs represents the specific volume of sucked gas, and Vx represents the specific volume of condenser inlet gas. The following table shows the limitation of the pipe inner diameter at every stroke volume, which was obtained by Equations 4 and 5 and in which the flow rate in the pipe becomes not larger than the zero penetration flow rate.

TABLE 1

| | SV(CC) Stroke Volume | | | | |
|---|---|---|---|---|---|
| | 3.09 | 3.57 | 4.18 | 4.60 | 5.00 |
| Te = −30° C. | | | | | |
| pipe inner diameter ϕ in [mm] | 3.77 | 3.99 | 4.25 | 4.42 | 4.57 |
| flow rate [m/s] | 0.778 | 0.80 | 0.826 | 0.842 | 0.816 |
| Te = −40° C. | | | | | |
| pipe inner diameter ϕ in [mm] | 3.08 | 3.27 | 3.48 | 3.61 | 3.74 |
| flow rate [m/s] | 0.703 | 0.724 | 0.747 | 0.761 | 0.775 |
| | SV(CC) Stroke Volume | | | | |
| | 5.86 | 7.14 | 8.36 | 9.20 | 10.0 |
| Te = −30° C. | | | | | |
| pipe inner diameter ϕ in [mm] | 4.86 | 5.26 | 5.60 | 5.825 | 6.02 |
| flow rate [m/s] | 0.883 | 0.919 | 0.948 | 0.966 | 0.983 |
| Te = −40° C. | | | | | |
| pipe inner diameter ϕ in [mm] | 3.98 | 4.31 | 4.59 | 4.763 | 4.924 |
| flow rate [m/s] | 0.799 | 0.832 | 0.858 | 0.874 | 0.889 |

This calculation was performed under the condition that the pipe was arranged vertically, and in the inlet of the condenser having the strictest condition as the result of calculation in each place.

Embodiment 2

Embodiment 2 of the present invention will be described with reference to FIG. 1. In the drawing, the reference numeral 5 represents a header located in the outlet of the evaporator 4 and for adjusting the excess and lack of the quantity of circulating refrigerant caused by the change of outside air, unit-in load and so on (which is a refrigerant liquid reservoir portion for adjusting the excess and lack of the quantity of refrigerant and needs a constant inner volume); 7, a dryer for absorbing moisture in the refrigerating cycle (which needs a constant inner volume in order to store a drying agent); and 8, a muffler provided on the suction side of a compressor for the sake of silencing, and, for example, having a large diameter partially (which needs a constant inner volume in order to have a silencing effect). The constituent elements of the refrigerating cycle which are thus larger in diameter than the pipe shown in Embodiment 1 make a flow horizontal or downward in order to improve oil return to the compressor. There is a case where the muffler is provided as an accumulator. In a refrigeration system, for example, a header or a muffler is used in some refrigerators, and a muffler is used in some air conditioners. However, no muffler and no accumulator are used in some air conditioner.

The silencing effect of the muffler is expressed by a theoretical equation stated in Equation 6. The quantity of attenuation of sound TL (dB) shown in this equation depends on an area ratio.

[Equation 6]

$$TL = 10\log_{10}\frac{1}{4}\left\{\left(1+\frac{m}{m'}\right)^2\cos^2 kL + \left(m+\frac{1}{m'}\right)^2\sin^2 kL\right\} + 10\log_{10}\frac{m'}{m}\ \text{(dB)}$$

(attenuation of sound)

where $m=S_2/S_1$ $m'=S_2/S_3$ f:frequency c:sound speed $k=2\pi f/c$

Embodiment 3

The outlet side of the evaporator 4 is connected to the upper side of the above-mentioned header 5, and the suction side of the compressor 1 is connected to the lower side. A suction pipe 9 of the compressor 1 is inserted into the header 5 and extended upwards so that the refrigerant in the header 5 flows from the upper side to the lower side.

As in a conventional header 5, if the lower side of the header 5 is connected to the outlet side of the evaporator 4 while the upper side is connected to the suction side of the compressor 1, and a refrigerant liquid reservoir portion is formed by a pipe inserted into the header 5 from the lower side toward the upper side, oil having no compatibility with refrigerant HFC134a, such as hard alkylbenzene oil, is reserved so that the quantity of oil in the compressor 1 is reduced, giving faults to lubrication or sealing of a sliding member. On the contrary, if the flow in the header 5 is turned upside down, refrigerator oil having a lighter specific gravity than the refrigerant is reserved in a comparative upper portion in the header 5, so that as soon as running is started, the refrigerator oil surely returns to the compressor 1 without being reserved in the header 5.

Embodiment 4

Figure 3:
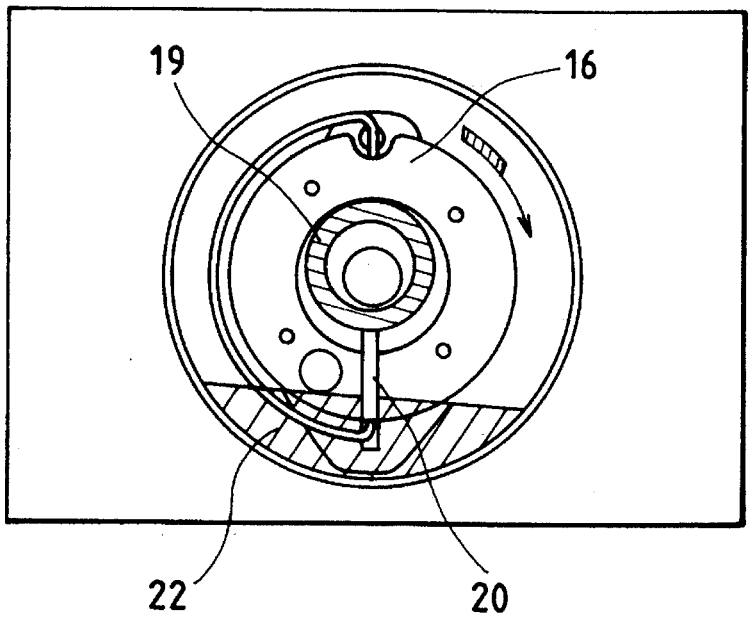
FIG. 3 is a diagram illustrating the section of a cylinder portion of a compressor according to the present invention.

In order to ensure the height of oil surface in the compressor even if all the volume in the header 5 up to the upper end portion of the above-mentioned inserted suction pipe arrangement 9 is filled with refrigerator oil, for example, in order to locate the oil surface in the upper of an oil supply mechanism portion or a sliding member, the volume of the header is made not more than the volume up to the upper end portion of the suction pipe arrangement (for example, the volume of the header up to the upper end portion of the suction pipe arrangement is made 40 cc). FIG. 3 shows this embodiment. In FIG. 3, refrigerator oil 22 in a compressor fixed to a transversal shaft is reserved so that the lower end portion of a vane 20 is put therein. Accordingly it is possible to supply oil to a sliding portion where the vane 20 and a rolling piston 19 contact with each other.

Embodiment 5

Figure 2:
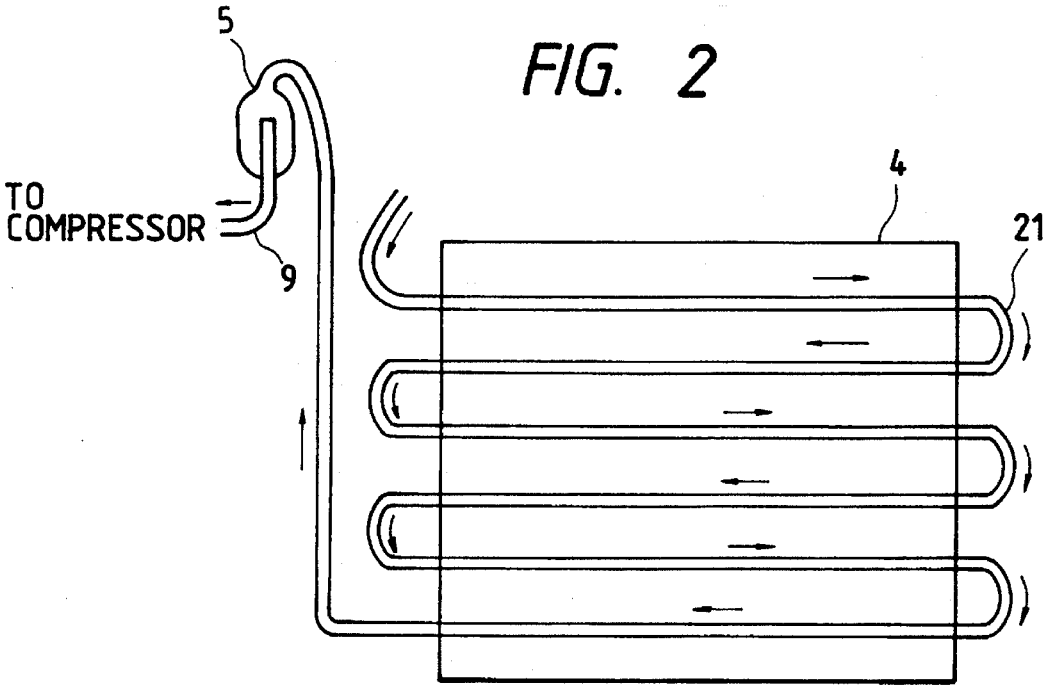
FIG. 2 is a partially detailed diagram of a refrigerant circuit according to Embodiment 5 of the present invention.
Figure 6:
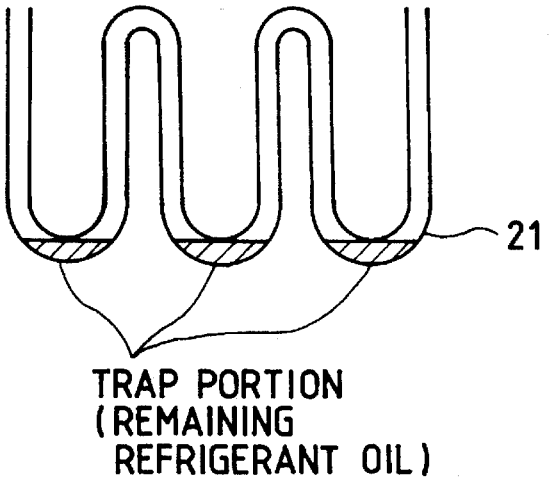
FIG. 6 is a diagram illustrating the flow of refrigerant in a condenser and an evaporator in a conventional refrigerating cycle.

The refrigeration flow in the above-mentioned condenser 2 and the evaporator 4 is made to be not vertical as shown in FIG. 6 but horizontal as shown in FIG. 2, so that a trap portion is reduced to the minimum so as to prevent refrigerator oil from being reserved.

The trap portion means an oil reservoir provided by bending a pipe of material such as copper, iron, aluminum or the like into a U-shape on the way of a heat exchanger or on the way of a straight pipe arrangement. Particularly in the case where U-shaped portions are provided vertically downward on the way of a heat exchanger or the like, each U-shaped portion becomes a portion where liquid such as oil, a refrigerant or the like is reserved as shown in FIG. 6. In the present invention, the flow of refrigerant in such a trap portion is made downward from the upper side to the lower side, horizontal, or upward. Accordingly it is possible to restrain the liquid reserved in such a liquid reservoir of this portion into the minimum.

An example of this will be described with reference to FIG. 4 in which the refrigerating cycle is applied to a refrigerator.

Figure 4:
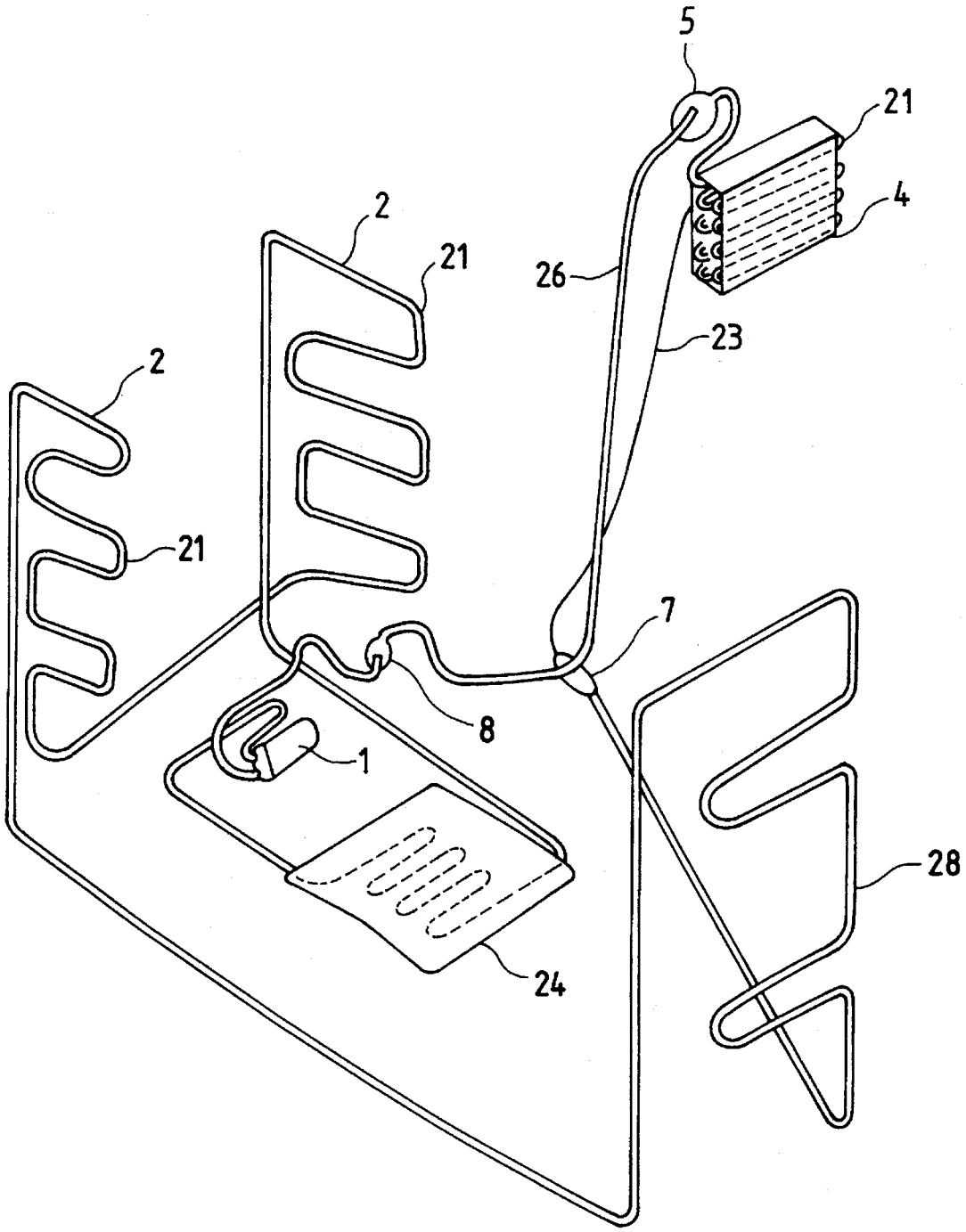
FIG. 4 is an explanatory diagram in which a refrigerating cycle according to the present invention is applied to a refrigerator.
Figure 5:
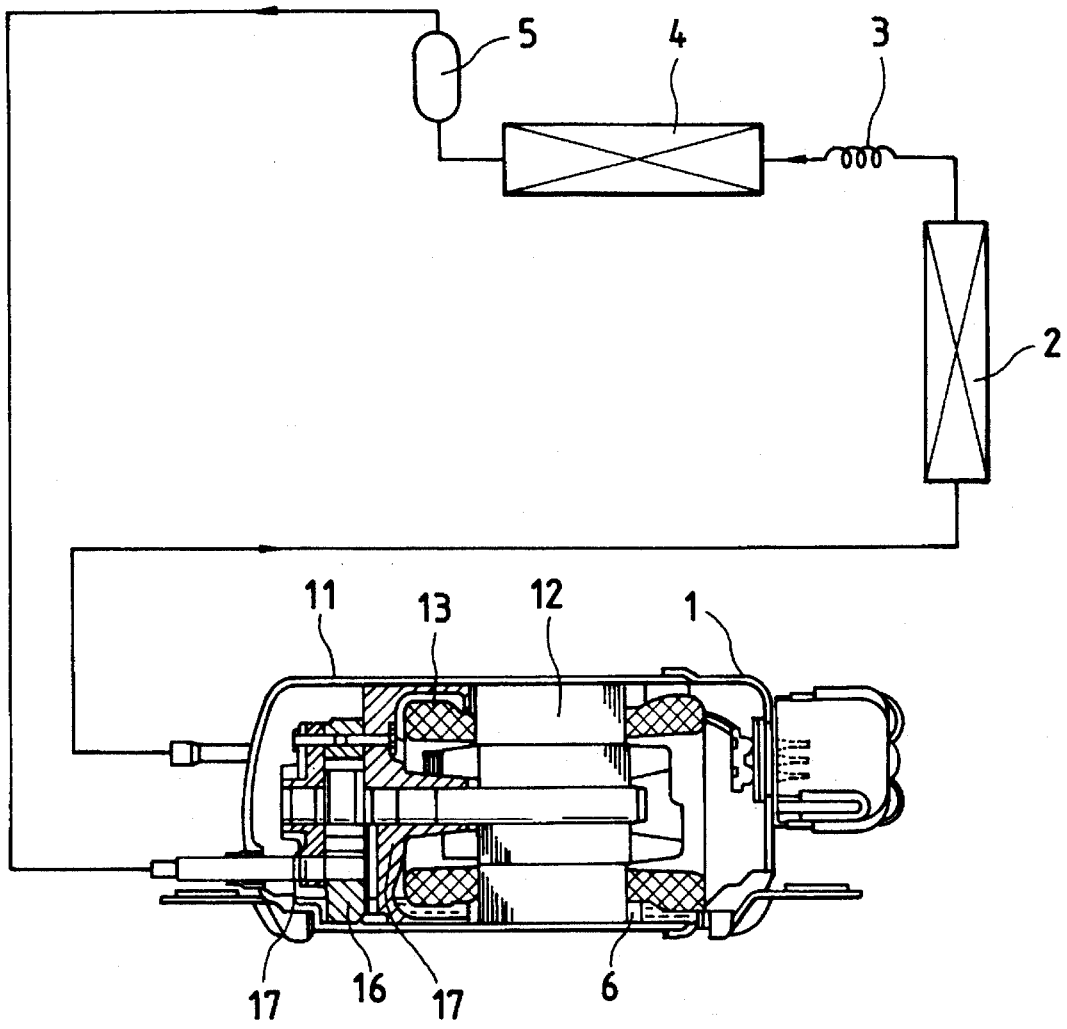
FIG. 5 is a structure diagram of a refrigeration unit using a conventional refrigerant compressor.

In FIG. 4, although refrigerant compressed by a compressor 1 together with oil flows into an evaporating plate 24, a condenser 2 bonded with the ceiling and side cabinet of the refrigerator, and a cabinet pipe 28, the refrigerant flows from the upper to the lower, or horizontally in a trap portion 21 of this portion. Accordingly there is no case where the refrigerant is reserved.

The refrigerant is sent to a cooler 4 through a capillary tube 23 provided on the back of the refrigerator, from a dryer 7 provided in a machine room together with the compressor and a muffler. A trap portion 21 in the cooler also has no liquid reservoir, so that oil also returns to the compressor 1 through a header 5 and a muffler 8 together with the refrigerant.

That is, in the example of a refrigerator, a trap portion is in the condenser, a heat exchanger of the evaporator, or a pipe arrangement in the machine room, and in the case of an air conditioner, a trap portion is in an outdoor or indoor heat exchanger, or in a refrigerant pipe arrangement in an outdoor machine.

Although the direction of flow in a trap portion is set to be in such a direction as to eliminate a liquid reservoir in the above description, not to say, it goes well if the direction is set to eliminate it in the state of installation.

Further, even if the trap portions itself, that is, U-shaped bent portions, are inclined slightly upward from the lower side to the upper side, it is possible to bring the reservoir of liquid into the minimum by reducing the number of the U-shaped portions.

Embodiment 6

The above-mentioned muffler 8 is located in a suction pipe 10 near the compressor 1 so that the refrigerant flows downward from the upper side to the lower side. The end portion at the lower side of the pipe is inserted into the muffler 8, and within the compressor, the pipe is provided at its lower side with a small hole 18 in a range of from &U1 to &U2. Even if the compressor 1 is stopped and the muffler 8 is filled with refrigerant and refrigerator oil, the refrigerant having a larger specific gravity is reserved in the lower portion while the refrigerator oil is reserved in the upper portion. The refrigerant returns to the compressor 1 through the small hole 18 sooner at the time of restarting, so as to reduce the load caused by sucking the oil into the compressor.

According to the present invention, in the refrigerating cycle using a refrigerant containing hydrofluorocarbon as a main component, of a refrigerant pipe arrangement constituting the refrigerating cycle, a refrigerant pipe extending upward from a lower side to an upper side is made to have an inner diameter not larger than a value which makes oil adhering to the inner wall of the refrigerant pipe rise when the refrigerant rises in the one pipe or which makes the flow rate of the refrigerant be not smaller than a zero penetration flow rate. Accordingly it is possible to obtain a refrigerating cycle superior in oil return to a compressor and hence high in reliability, even by use of refrigerator oil having no compatibility with refrigerant containing hydrofluorocarbon as a main component.

According to the present invention, in the refrigerating cycle using a refrigerant containing hydrofluorocarbon as a main component, a constituent element of the refrigerating cycle where the flow rate of the refrigerant is not larger than a zero penetration flow rate is designed so as to make the direction of flow of the refrigerant in the constituent element be horizontal or downward. Accordingly it is possible to obtain a refrigerating cycle superior in oil return to a compressor without reserving oil in a pipe arrangement, even by use of refrigerator oil having no compatibility with a refrigerant containing hydrofluorocarbon as a main component.

According to the present invention, in the refrigerating cycle, a header provided in an outlet of an evaporator is designed so as to make the direction of flow of the refrigerant downward, and a suction pipe on the lower side of the outlet of the header is inserted into the header. Accordingly, refrigerator oil lighter in specific gravity than a refrigerant containing hydrofluorocarbon as a main component is reserved in an upper portion of the header so that the refrigerator oil returns to the compressor without being reserved in the header as soon as running is started.

According to the present invention, in the refrigerating cycle, the internal volume of the header up to the upper surface of the suction pipe inserted to the header is set so as to cause no trouble against running of a compressor even if the quantity of refrigerator oil reserved in the header increases. Accordingly it is possible to obtain a refrigerator cycle giving no troubles to the running of the compressor even if the refrigerator oil is reserved up to the upper end surface of the suction pipe inserted into the header.

According to the present invention, it is possible to obtain a refrigerating cycle in which refrigerator oil is not reserved in a trap portion.

According to the present invention, in the refrigerating cycle, a muffler provided on the suction side of a compressor makes the direction of flow of the refrigerant downward, a pipe on the outlet lower side is inserted into the muffler, and a small hole is provided in a lower portion of the pipe at the inserted portion thereof. Accordingly, even if the muffler is filled with the refrigerant and the refrigerator oil, the refrigerant larger in specific gravity is reserved in the lower side while the refrigerator oil is reserved in the upper side so that the refrigerant returns to the compressor through the small hole sooner at the time of restarting, and it is possible to reduce the load caused by sucking oil into the compressor.

What is claimed is:

1. A refrigerating cycle using a refrigerant containing hydrofluorocarbon as a main component and a refrigerator oil substantially all of which is insoluble with said refrigerant, wherein, of a refrigerant pipe arrangement constituting said refrigerating cycle, a refrigerant pipe extending upward from a lower side to an upper side is made to have an inner diameter not larger than a value which makes oil adhering to an inner wall of said refrigerant pipe rise when said refrigerant rises in said one pipe.

2. A refrigerating cycle according to claim 1, wherein an inner diameter of said refrigerant pipe is made not larger than a value which makes an flow rate of said refrigerant be not smaller than a zero penetration flow rate.

3. A refrigerating cycle according to claim 1, wherein liquid reserved in a U-shaped portion of a trap portion of said refrigerant pipe is made to be minimum.

4. A refrigerating cycle using a refrigerant containing hydrofluorocarbon as a main component and a refrigerator oil substantially all of which is insoluble with said refrigerant, wherein a constituent element of said refrigerating cycle where a flow rate of said refrigerant is not larger than a zero penetration flow rate is designed so as to make a direction of flow of said refrigerant in said constituent element be lateral or downward.

5. A refrigerating cycle according to claim 4, wherein a liquid reservoir portion provided in at least one of an outlet of an evaporator and a suction side of a compressor is designed so as to make the direction of flow of said refrigerant downward, and a suction pipe on a lower side of said outlet of said liquid reservoir portion is inserted into an inside of said liquid reservoir portion.

6. A refrigerating cycle according to claim 5, wherein an internal volume of said liquid reservoir portion up to an upper surface of said suction pipe inserted to said liquid reservoir portion is set so as to cause no trouble against running of a compressor even if a quantity of refrigerator oil reserved in said liquid reservoir portion increases.

7. A refrigerating circuit according to claim 6, wherein at least one of the liquid refrigerant and the refrigerator oil can be reserved at a constant amount up to the upper surface of said suction pipe inserted to the inside of said liquid reservoir portion.

8. A refrigerating cycle according to claim 4, wherein liquid reserved in a U-shaped portion of a trap portion of said refrigerant pipe is made to be minimum.

9. A refrigerating cycle according to claim 4, wherein a liquid reservoir portion provided on a suction side of a compressor has a small hole provided in a lower portion of said pipe at the inserted portion thereof.

10. A refrigerator comprising:

a refrigerant containing hydrofluorocarbon as a main component;

a refrigerator oil substantially all of which has no compatibility with said hydrofluorocarbon; and a refrigerant pipe arrangement connecting a compressor in which said refrigerator oil is reserved and a condenser to an evaporator for circulating said refrigerant, and said refrigerant pipe arrangement including an ascending pipe having an inner diameter which makes a flow rate of said refrigerant be not smaller than such a value that said refrigerator oil adhering to an inner wall of said pipe rises against its own gravity when said refrigerant flows upward from a lower side to an upper side.

11. A refrigerator comprising:

a refrigerant containing hydrofluorocarbon as a main component;

a refrigerator oil substantially all of which has no compatibility with said hydrofluorocarbon; and a refrigerating circuit constituted by connecting a compressor in which said refrigerator oil is reserved and a condenser to an evaporator through a refrigerant pipe, wherein a pipe of a constitute element of said refrigerating circuit where the flow rate of said refrigerant within said pipe is not larger than a zero penetration flow rate is designated so as to make a direction of flow of said refrigerant in said pipe be lateral or downward.

12. A method of assembling a refrigerant compressing apparatus having a compressor connected to a refrigerating circuit for circulating a refrigerant containing hydrofluorocarbon as a main component, said refrigerating circuit having at least a compressor and an evaporator as constitute elements, the method comprising the steps of:

reserving an oil substantially all of which has no compatibility with said hydrofluorocarbon in said compressor; and disposing a pipe, of a pipe arrangement connecting a constitute element of said refrigerating circuit to said compressor, where a flow rate of said refrigerant within said pipe is not larger than a zero penetration flow rate so that a direction of flow of said refrigerant in said pipe is made lateral or downward; and wherein, of said pipe arrangement connecting a constitute element of said refrigerant circuit to said compressor, an ascending pipe where said refrigerant flows upward from a lower side to an upper side is constituted by a pipe having an inner diameter which makes the flow rate of said refrigerant be not smaller than such a value that said refrigerator oil adhering to an inner wall of said pipe rises against its own gravity.

* * * * *